United States Patent [19]

Frahme

[11] Patent Number: 4,633,637

[45] Date of Patent: Jan. 6, 1987

[54] HEAT INSULATING MODULE AND METHOD OF ASSEMBLY FOR USE IN A HIGH TEMPERATURE CHAMBER

[75] Inventor: Carl E. Frahme, Canyon Country, Calif.

[73] Assignee: Industrial Insulations, Inc., Industry, Calif.

[21] Appl. No.: 824,111

[22] Filed: Jan. 30, 1986

[51] Int. Cl.[4] ..... F23M 5/00; E04B 1/80

[52] U.S. Cl. ..... 52/512; 52/506

[58] Field of Search ..... 52/506, 508, 512, 404, 52/509; 110/331

[56] References Cited

U.S. PATENT DOCUMENTS 3,854,262 12/1974 Brady ..... 52/506
4,440,099 4/1984 Brachet et al. ..... 52/506 X
4,449,345 5/1984 Hounsel et al. ..... 52/506
4,516,374 5/1985 Finney ..... 52/509 X

*Primary Examiner*—J. Karl Bell
*Attorney, Agent, or Firm*—Sellers & Brace

[57] ABSTRACT

Disclosed is a heat insulating module and a method of making the same for use in lining a high temperature chamber. The module has a main body formed of layers of refractory fibers positioned side by side and impaled on at least one rigid tie member spaced inwardly of one lateral edge of all layers with the ends of the tie member secured to one leg of L-shaped mounting members with the other legs thereof extending outwardly beynd the end layers of the module and coplanar with the adjacent lateral edge of said layers. The layers may be interconnected by folding a unitary blanket of fibers and, in either assembly mode, the layers are held snugly compressed by at least one encircling tie band.

9 Claims, 2 Drawing Figures

Figure 1:
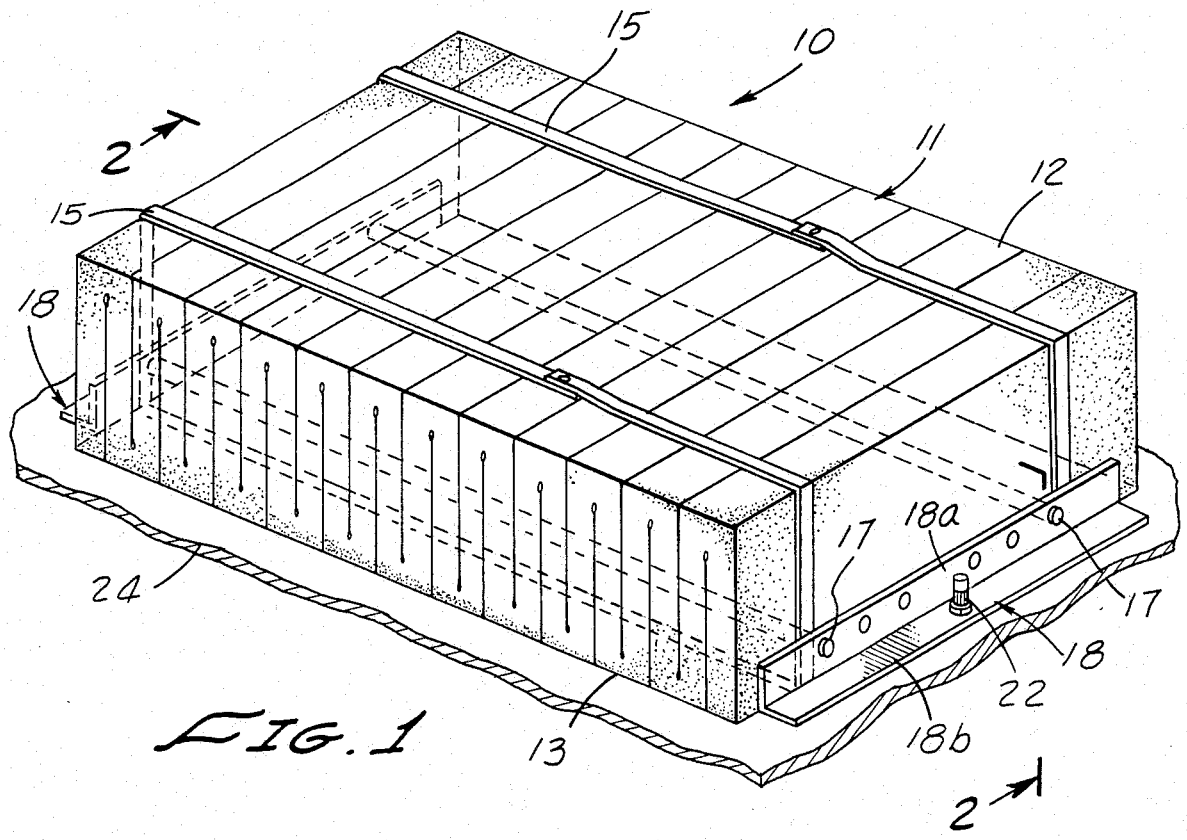

HEAT INSULATING MODULE AND METHOD OF ASSEMBLY FOR USE IN A HIGH TEMPERATURE CHAMBER

This invention relates to high temperature heat insulating linings, and more particularly to a unique and improved heat insulating module and method of making the same for installation in abutment with other similar modules to provide a high temperature lining for furnaces and the like high temperature chambers.

BACKGROUND OF THE INVENTION

Various proposals have been made heretofore for providing a furnace and the like high temperature chambers with an insulative lining avoiding the disadvantages of rigid refractory material such as bricks and cast components. Such proposals involve the use of refractory fibers formed into mats, slabs, blankets and other configurations. The refractory or ceramic fibers are customarily laid down in randomly arranged layers interbonded to one another at points of crossover. Typically, chambers insulated with refractory fibers operate in a temperature range of 1,600 degrees to 2,800 degrees F. a satisfactory insulation assembly utilizing refractory fibers requires an insulation thickness of four to six inches or more. Blankets of such fibers are applied with the layers lying generally parallel to the chamber wall, serious problems are encountered including those of securing the blankets to the wall and particularly the problem of delamination and spalling or peeling off of successive surface layers resulting in a relatively short service life. To avoid these problems and others associated therewith it has been the practice to utilize a wide variety of arrangements in which the fiber blankets, one to two inches thick are secured to the chamber wall with the fiber layers lying in planes generally normal to the chamber wall. This avoids the serious delamination and spalling problems but presents other problems associated with the assembly of liner modules or components formed of multiple layers held assembled in side-by-side relation and provided with suitable heat resistant means for securing the assembly to the chamber wall. Another problem present in modules formed of layers of fibers held compressed against one another adjacent the outer or cold face of the module results in the inner or hot face being unrestrained and free to flare away from one another. This flaring tendency of the unrestrained layers is highly desirable when the modules are installed closely adjacent one another but can handicap the installation operation because interfering with the workman's access to fasteners securing the module to the chamber wall. Additionally the flaring edges of the end layers present packaging and stowage problems prior to installation and these unprotected edges are exposed to handling damage.

Patents in this art dealing with these problems and proposing a variety of solutions include: Sauder et al U.S. Pat. No. 3,819,468; Ballaz et al U.S. Pat. No. 3,832,815; Brady U.S. Pat. No. 3,854,262; Monaghan U.S. Pat. No. 3,892,396; Sauder et al U.S. Pat. No. 3,940,244; Byrd U.S. Pat. No. 3,952,470; Byrd U.S. Pat. No. 4,001,996; Byrd U.S. Pat. No. 4,012,877; Byrd U.S. Pat. No. 4,103,469; Myles U.S. Pat. No. 4,120,641; Byrd U.S. Pat. No. 4,123,886; Cunningham et al U.S. Pat. No. 4,218,962; Severin et al U.S. Pat. No. 4,287,839; Hounsel et al U.S. Pat. No. 4,381,639; European Patents Publication No. 0,018,677 and U.K. patent application No. 2,004,626 A.

The two Sauder patents propose a complex module assembly formed of a multiplicity of individual strips of refractory fiber mounted along one edge to an expanded metal backing or held assembled to a backing layer of fibers by means of a complex series of tie wires crisscrossing one another. The several Byrd patents show different techniques for folding a ceramic blanket with certain folds embracing an elongated anchor member provided with tang means protruding outwardly through the folds with the outer end clenched to an elongated mounted strip securable to a furnace wall.

The Cunningham and Hounsel patents show closely related variants of the several Byrd teachings. Bolus and Brady both propose modules composed of separate strips of refractory fibers required to be assembled individually in side-by-side relation and held assembled by a plurality of pins on which all strips are impaled and secured to retain members at the opposite ends of the pins. Brady's clamping pins are staggered relative to one another and the retaining members are secured to a mounting plate coextensive with the outer edges of the strips and securable to a furnace chamber, whereas Balaz extends his pins through eye bolts utilized to clamp the module to the chamber wall. Monaghan secures one end of L-shaped mounting hooks to the chamber wall and having a pointed leg extending upwardly and spaced from the wall. Individual strips of insulating fibers are then impaled over the upright legs. Miles places a multiplicity of ceramic fiber strips in side-by-side relation and bonds one lateral edge to an expanded metal mounting strip. The module is then secured to the wall by round ended buttons forcibly inserted into respective expanded metal openings.

Severin et al, proposes a pleated ceramic fiber blanket utilizing a multiplicity of components including a channel shaped baseplate, a pair of rods piercing all pleats and having their ends anchored in tabs secured to a base plate provided at its corners with J-shaped suspension bolts engageable with pairs of rods mounted on the interior of a furnace wall. The European publication extends ceramic tubes through adjacent layers of refractory fibers. These tubes also pierce one end of suspension ceramic tubes having their other ends projecting beyond the cold edges of the layers and serving to seat hook members engageable with the structural elements of the chamber wall. The outermost edges of the layers are also bonded to one face of large ceramic baseplate. Modules formed by this technique are sufficiently large to extend across the width of a furnace wall.

SUMMARY OF THE INVENTION

This invention avoids the complexities and costly manipulative operations required to manufacture and assembly prior heat insulating modules and equipped with expedients for mounting them on a chamber wall. These advantages are achieved by impaling a multiplicity of similar layers of refractory fiber on either one or a pair of tie members spaced inwardly of one lateral edge of the layers. These tie members pierce all layers and their ends are secured to one leg of separate L-shaped mounting members thereby holding all layers compressed against one another and the other leg of the mounting members lying coplanar with the cold wall of the module and projecting away from one another. All layers are also preferably snugly encircled by tie bands effective to hold the entire width of the layers equally compressed for greater protection and ease of handling and mounting of the modules against a chamber wall. These tie bands are subject to destruction when the chamber is first placed in operation and then allow the hot edges of the layers to expand against the layers of neighboring modules to provide a continuous gapless lining for the chamber.

Accordingly, it is a primary object of this invention to provide a unique, low cost, simplified heat insulating module as a lining for a high temperature chamber.

Another object of the invention is the provision of an improved method of assembling a heat insulating module formed of layers of refractory fibers traversed near the cold face thereof with tie members secured to module mounting members and wherein the layers are held snugly compressed by encircling tie bands prior to use in a furnace chamber.

Another object of the invention is the provision of a high temperature insulating module formed from a folded blanket of refractory fibers held snugly compressed by encircling destructible band means and impaled by tie members adjacent the cold face of the module secured at their ends to L-shaped module mounting members.

These and other more specific objects will appear upon reading the following specification and claims and upon considering in connection therewith the attached drawing to which they relate.

Figure 2:
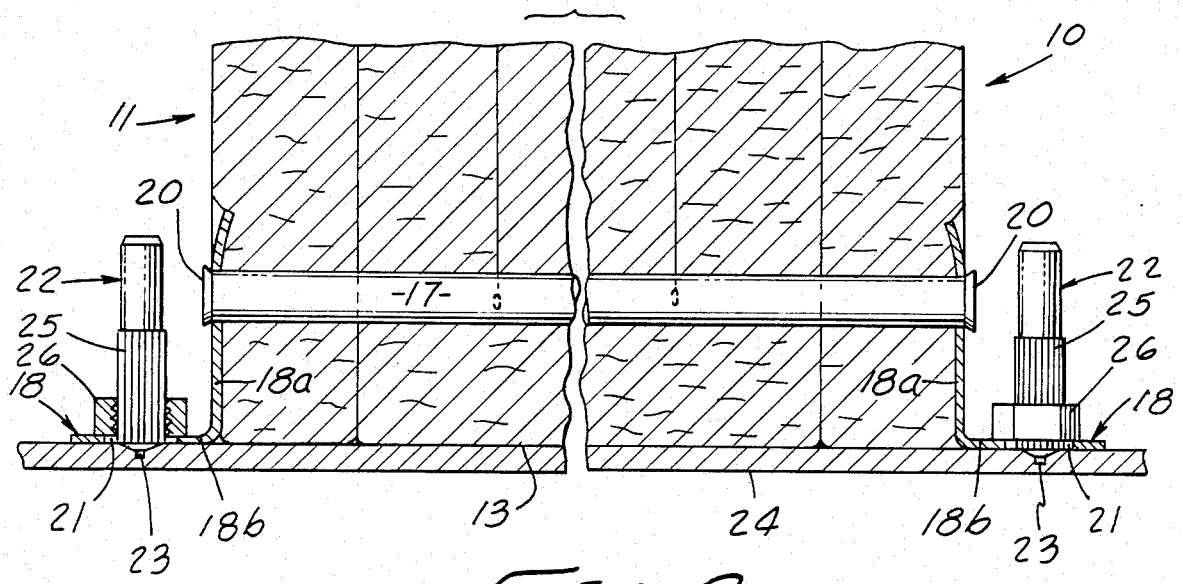

Referring now to the drawing in which a preferred embodiment of the invention is illustrated:

FIG. 1 is a perspective view of an illustrative embodiment of the invention heat insulating module after installation against the inside of a high temperature chamber wall; and FIG. 2 is a fragmentary cross sectional view on an enlarged scale taken along line 2—2 on FIG. 1.

Referring to the drawing, there is shown an exemplary embodiment of the invention module designated generally 10. The module may be of various configurations but as there shown it is square and has a main body formed from a single unitary blanket 11 of superimposed layers of refractory ceramic fibers. Commercially available blankets of such fibers typically provide long service life under temperature conditions as high as 2,600 degrees F. or higher, the fibers being arranged randomly in layers parallel to the blanket surfaces. Such blankets are of uniform thickness and folded into similar pleats with the pleat layers held compressed against one another and the fiber layers lying generally normal to the two parallel faces 12 and 13. The folds between adjacent layers forming face 12 are exposed to the high temperature of the chamber being insulated and is known as the hot face of the module whereas the folds on the other face 13 face toward the chamber wall and constitute the cold face of the module. Preferably the opposite ends of the blanket lie coplanar with the cold face of the completed module.

The blanket is readily folded into accordion pleats by placing the outstretched strip of blanket material over the top edges of a series of upright partition plates following which portions of the blanket between the upper edges of adjacent plates are pressed downwardly between adjacent pairs of plates in succession until all pleats have been formed. The partition plates are slotted downwardly from their upper edges to a point near but spaced upwardly from the lower edges of the partition plates. At least one, and preferably two, tie members are then pressed through the layers of the folded blanket. This operation is facilitated by inserting a pointed pilot member in the leading end of a tubular tie member. The semifinished module is then lifted clear of the partition plates and a pair of bands 15 are assembled about the layers of ceramic fibers to hold all layers snugly compressed against one another. Any suitable banding material may be employed which will be subject to destruction as the chamber in which the module is installed is being brought up to an operating temperature. However, prior to that time, all layers are preferably held firmly and snugly compressed such as in the rectangular configuration shown in FIG. 1.

The opposite ends of the tubular tie members 17, 17 project from the opposite ends of the module and are assembled to angle iron mounting members 18 with the upright leg 18*a* of each iron assembled over the adjacent end of the tie members and secured in place as by expansion or outward upsetting of each end 20. The other legs 18*b* extend outwardly away from one another in a plane generally coplanar with the cold face 13 of the module. These legs are provided with at least one opening 21 to receive mounting fasteners for the module.

A convenient form of fastener comprises studs 22 having an axial tip 23 at one end to facilitate its assembly to a metallic furnace wall 24 by electric resistance welding. The adjacent end of the stud, is here shown provided with outwardly projecting flutes 25 of triangular cross section with their pointed outer crests lying outwardly of the remaining main body of the studs. These studs are assembled to the interior of the furnace chamber in a desired pattern such that the module mounting members 18 can be readily installed thereover. Once the module is in place over the studs threaded nuts 26 are assembled over the smaller outer end of the studs and then forcibly pressed downwardly over the flutes 25 thereby pressing the mounting members 18 snugly against the furnace chamber. The hardened flutes 25 cut into the nut threads and provide a high strength fastener assembly adequately strong to hold the entire lightweight module 10 firmly installed. A single fastener stud at each end of the module is found satisfactory for smaller modules but larger module assemblies may employ a pair of studs at each end.

Bands 15 of plastic or other nonmetallic material are installed during the pleating operation and serve to hold the ceramic fiber material compressed particularly adjacent the hot face at all times prior to actual use of the modules in the furnace and particularly while being installed. This provides the installer with unobstructed visual access to studs 22 during installation. Many users install the modules parquet fashion so that the mounting members of adjacent modules do not interfere with one another during installation. Once the chamber is placed in use bands 15 fail and are destroyed as the temperature rises. This permits the hot face to expand into firm contact with adjacent modules to provide a gapless and continuous high temperature lining of insulation material.

While the particular heat insulating module and method of assembly for use in a high temperature chamber herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A unitary heat insulating module adapted to be handled and/or secured to the interior side of a high temperature chamber as a unitary assembly comprising:

a multiplicity of rectangular layers of refractory fibers held pressed against one another and impaled on at least one tie member extending through each of said layers adjacent but spaced inwardly from one longer edge of said layers; and a single pair of elongated L-shaped mounting members having one leg of each lying parallel to one another adjacent a respective end of said at least one tie member and secured thereto thereby to hold all of said layers compressed and snugly secured against one another on said at least one tie member and the other leg of said mounting members lying in a common plane close to and parallel to said one longer edge of said layers and extending away from one another along and outwardly of the opposite sides of said module and accessible for use in securing said unitary module assembly to the interior side of a high temperature chamber.

2. A unitary module assembly as defined in claim 1 characterized in the provision of banding means encircling said multiplicity of layers and holding said layers snugly and generally uniformly compressed until said module has been installed between adjacent modules in a high temperature chamber.

3. A unitary module assembly as defined in claim 1 characterized in that said layers attached to one another and part of a single blanket of refractory fibers folded accordion fashion with alternate folds lying coplanar with one another crosswise of a respective side of said module.

4. A unitary module assembly as defined in claim 1 characterized in the provision of tie band means encircling said layers inwardly of said mounting members and holding said layers snugly compressed against one another.

5. A unitary heat insulating module adapted to be handled and/or secured to the interior of a high temperature chamber as a unitary assembly comprising:

a multiplicity of layers of refractory fibers held assembled one against another and impaled on at least one tie member piercing said layers in an area spaced inwardly from one lateral edge of said layers of refractory fibers; and a pair of L-shaped module mounting members having one leg of each traversed by and secured to a respective end portion of said at least one tie member and having the other leg of each of said mounting members lying pressed against the surface generally flush with one set of lateral edges of said layers of refractory fibers and extending away from one another and beyond a respective outermost layer of said module and the other leg of said mounting members being adapted for use in securing said unitary module to the wall of a high temperature furnace with a lateral edge of said module pressed snugly against the lateral edge of the adjacent one of said modules.

6. That method of assembling and storing a high temperature module adapted to be handled and/or secured to the interior side of a high temperature chamber as a unitary assembly comprising:

folding a unitary blanket of interbonded refractory fibers into a plurality of similar layers with the folds thereof lying in spaced apart parallel planes;

piercing said layers with a plurality of rigid tie members generally parallel to one another and spaced closely inwardly of said folds crosswise of one side of said folded blanket;

wrapping said folded blanket with tie strap means to hold said folded layers snugly against one another; and securing a separate mounting member of L-shape in cross section to said tie members crosswise of the ends thereof with one leg of each lying pressed against the outer surface of the adjacent end layer of said folded blanket and with the other legs thereof extending away from one another and lying generally coplanar with the adjacent face of said module.

7. That method of assembling and storing a high temperature module as defined in claim 6 characterized in the step of maintaining said tie strap means in place at least until said module has been delivered to an installation site.

8. That method defined in claim 6 characterized in the step of maintaining said tie strap means in place until said module has been installed in a high temperature chamber.

9. That method defined in claim 6 characterized in the step of utilizing tubular tie members and upsetting the opposite ends thereof after inserting the same through openings in said one flange of said angle irons to hold said angle irons and said tie members assembled to one another and to the layers of said folded blanket.

* * * * *